United States Patent [19]

Faure

[11] 4,066,312

[45] Jan. 3, 1978

[54] HIGH DENSITY CABLE CONNECTOR

[75] Inventor: Louis H. Faure, Poughkeepsie, N.Y.

[73] Assignee: International Business Machines Corporation, Armonk, N.Y.

[21] Appl. No.: 700,275

[22] Filed: June 28, 1976

[51] Int. Cl.[2] ..... H01R 15/22

[52] U.S. Cl. ..... 339/48; 339/117 P

[58] Field of Search ..... 339/48, 49, 64, 150, 339/151, 117 P, 252 R, 254 R, 254 M, 210 R, 210 M

[56] References Cited

U.S. PATENT DOCUMENTS

| | | | |
|---|---|---|---|
| 169,732 | 11/1875 | Ryder | 339/48 |
| 1,394,057 | 10/1921 | Woernley | 339/48 |
| 1,687,074 | 10/1928 | Wichert | 339/48 |
| 2,750,572 | 6/1956 | Fox | 339/210 M |
| 2,890,433 | 6/1959 | Liljenberg | 339/48 |
| 3,030,602 | 4/1962 | Jackson et al. | 339/64 M |
| 3,242,456 | 3/1966 | Duncan | 339/64 M |
| 3,441,898 | 4/1969 | Nodfelt | 339/48 |
| 3,605,068 | 9/1971 | Rayburn | 339/49 R |
| 3,665,509 | 5/1972 | Elkins | 339/117 P |
| 3,806,801 | 4/1974 | Bove | 324/72.5 |

FOREIGN PATENT DOCUMENTS

| | | | |
|---|---|---|---|
| 1,033,752 | 7/1958 | Germany | 339/48 |
| 994,138 | 6/1965 | United Kingdom | 339/48 |

OTHER PUBLICATIONS

IBM Tech. Disc. Bulletin, Faure et al., Pin Pad Contacter, vol. 17, No. 2, July 1974, pp. 444–445.

IBM Tech. Disc. Bulletin, Anzalone et al., vol. 17, No. 2, July 1974, pp. 440–441.

IBM Tech. Disc. Bulletin, Faure et al., Controlled Direction Buckling Beam, vol. 17, No. 5, Oct. 1974, p. 1375.

*Primary Examiner*—Roy Lake
*Assistant Examiner*—Neil Abrams
*Attorney, Agent, or Firm*—Wolmar J. Stoffel

[57] ABSTRACT

A connector for forming a plurality of electrical wiring connections having a first mateable coupling member with a flat surface and a plurality of openings arranged in a predetermined configuration, a plurality of headed elements disposed in the openings, a second mateable coupling member provided with a flat surface, a set of elongated axially flexible metal buckling beam elements supported on the mateable coupling member and arranged in a predetermined configuration, corresponding to the headed elements on the first member, a means for supporting the buckling beam elements in a position generally perpendicular to the flat surface on the second member, with the ends of the buckling beam elements protruding slightly beyond the flat surface, a means for aligning the first and second members in mateable relation with the respective flat surfaces in opposed relation, and means for securing and maintaining the first and second members in mateable relation with the ends of the beam elements in a flexed position and in contact with the headed elements.

8 Claims, 4 Drawing Figures

HIGH DENSITY CABLE CONNECTOR

BACKGROUND OF THE INVENTION

This invention relates to providing electrical connections, more particularly to a connector for electrically joining a plurality of wires to form a detachable connection.

Connectors for joining a plurality of wires are commercially available. Many such connectors have been designed and are in use at the present time. However, the known connectors, particularly the high density wire connectors, have been unsatisfactory for certain applications. In most connectors, wires must be joined to terminals on plugs and receptacles that are closely spaced and very small. Joining by the usual methods i.e. crimping or soldering becomes very time consuming, tedius, and difficult. Further, in order to make a dependable electrical connection, the surfaces to make electrical contact should be subjected to a wiping action to remove any scale and/or oxide on the surfaces. When the connection contains many wires and contacts, this becomes very important and more difficult to achieve. Further, the contact surfaces should also be spring-biased to insure continued contact. When the number of contacts in the connectors becomes large, the force necessary to make the connection becomes substantial. These factors make the design of a connector, particularly high density miniaturized connectors, a complex task. In applications where dependability is of prime importance, such as computer applications, the need for an improved connector is great.

SUMMARY OF THE INVENTION

In view of these and other problems in the art, it is an object of the present invention to provide an improved, high density detachable connector for joining electrical connectors.

Another object of this invention is to provide a connector wherein attaching wires to the connector elements is facilitated because the wires can be fanned out and connected to the connector prior to its assembly.

Another object of this invention is to provide a connector element that is more dependable in operation since the contact surfaces are subjected to a wiping followed by a biasing force during joining and use.

Yet another object of this invention is to provide a large scale connector with spring-biased contact surfaces which can be simply joined.

These and other objects of the invention are achieved by the connector having first and second mateable coupling members each having a flat surface adapted to be disposed in abutting relation, a plurality of headed elements disposed in one of the coupling members in a predetermined configuration, a set of elongated axially flexible buckling beam elements in the second coupling member disposed in a position generally perpendicular to the flat surfaces with the ends thereof protruding beyond the flat surface, alignment means for aligning the first and second members, and a means for securing the first and second members in mateable relation.

DESCRIPTION OF THE PREFERRED EMBODIMENTS

Figure 1:
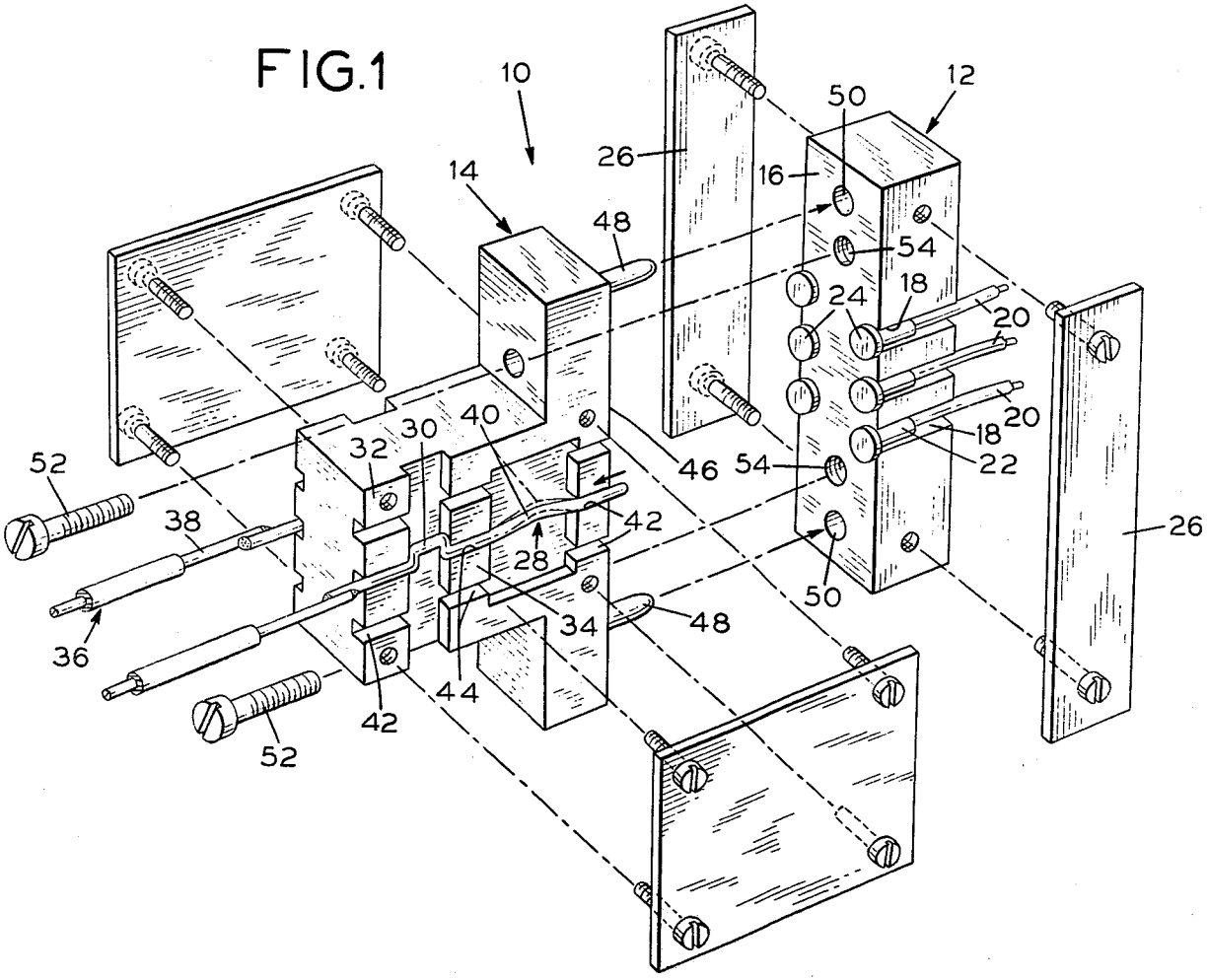
FIG. 1 is a perspective view in exploded relation illustrating the various elements of a preferred specific embodiment of the connector of the invention.

Referring now to the drawings, there is illustrated in FIG. 1 a preferred specific embodiment 10 of the connector of my invention. Connector 10 has a pair of mateable coupling members 12 and 14. Coupling member 12 has a flat surface 16 with a plurality of openings 18 adapted to receive the terminations of wires 20. Headed elements 22 are disposed in apertures 18 which form one-half of the connector. As illustrated in FIG. 1, the apertures consist of slots formed in the sides of member 12. Thus, in assembling the wires to the coupling member, the headed elements 22 can be soldered, crimped or otherwise attached to the wires 20 prior to their assembly to the apertures 18. By fanning out the ends of the wires, the attachment of the headed member 22 is thus greatly facilitated. The wires can also be quickly and easily interchanged. Headed element 22 is provided with an enlargement on the end thereof having a flat surface 24. The side plates 26 are secured to the coupling member 12 by any suitable means, as for example bolts or screws to thereby maintain the headed elements 22 in assembled relation. The opposed coupling member 14 is made of suitable plastic or other insulating material and has disposed in the sides thereof a plurality of buckling beam elements 28. The buckling beam elements 28 constitute the heart of the connector element. Beam elements 28 are formed of a flexible wire having a length of flexible wire that is much greater than the diameter of the wire itself. Beam elements 28 each have a U-shaped anchoring portion 30 secured to the mating element 14 in any suitable manner, as for example by disposing same between two abutments 32 and 34, which prevent longitudinal movement of the beam as well as rotation. The wires 36 are secured by crimping or soldering to the ends 38 that protrude from coupling element 14. The buckling beam also has a relatively long flexible portion 40 that has one end slidably received in a notch 42 in coupling member 14 and the opposite end disposed in a spaced groove 44. As indicated, the ends of beams 40 protrude slightly beyond the surface 46 of element 14. The clearance between beam 28 and the walls of notch 42 is such that it permits a lateral movement to provide a wiping or scrubbing action which improved the electrical contact. The buckling beam concept as it is applied to a probe contactor is described in detail in U.S. Pat. No. 3,806,801 and assigned to the same assignee as the present invention.

In general, the wire of the buckling beam probe, particularly that of the elongated portion 40, is formed of a suitable material which will continue to deflect over a predetermined range when a predetermined force is applied. Suitable examples of the material of the wire of the beam include BeNi, BeCU, tungsten, and electrical contact alloy sold under the trademark of Paliney by J. M. New Company, Bloomfield, Connecticut, and an electrical contact alloy sold under the trademark Niborium "B" by Niborium Industries Inc., Providence, R.I. When the beam is placed into contact with the headed elements and the opposed member 14 moved toward the opposing element 12, the beam 28 will flex or buckle. As the movement continues, the buckling or flexing will continue without any significant increase in the force applied. Thus, a relatively uniform force is applied to all of the electrical contacts in the connector, largely independent of any variations in the height of the headed elements 18. The wire portion 40 of the beam elements 28 are designed in accordance with the formula $$F = [3\pi]^2 \frac{El}{L^2}$$

where F is the axial load on the end of the beam which will cause buckling of the portion 40, E is the modulus of elasticity of the material of the beam, I is the least moment of inertia of the flexed portion 40 of beam 28, and L is the length of the beam. If the beam is a solid rod having a circular cross-section $I = \pi D^4/64$ where D is the diameter of the wire. By selecting the desired force which is to be applied to each of the buckling beams which will cause buckling of the portion 40 and with E known because of the selection of the material of the beam, and D known because of the area of the beam, only L is unknown in the formula. As a result, the required length of the flexing portion of the beam can be readily ascertained. Thus, by controlling the length of the wire of the beam relative to its area, a predetermined and selected force is applied to the headed elements of the connector member. As mentioned previously, as the beam 28 is flexed, the end portion protruding beyond the coupling member 14 is pivoted within the slot on member 14. Thus, flexing or buckling of the beam causes longitudinal movement of the end of the beam as well as a small transverse movement which provides a wiping action that cleans and removes any oxide or material from the headed contact element 18 as the connector is closed. Due to the relatively small longitudinal dimension of the buckling beam 28, a large number of electrical contacts can be enclosed in a relatively small volume, thereby making it possible to reduce the size of the connector element. It should be pointed out that it is desirable that all of the buckling beams 28 flex in the same direction. The space provided in coupling member 14 between the member itself and plate 46 is slightly larger than the diameter of the beam 28. This restricts the movement in a single plane. Additionally, each of the elements is positioned so that the buckling occurs in the same direction. It is understood that the ends of the buckling beams 28 can be secured in any suitable manner. The preferred manner shown in FIG. 1 consists of a U-shaped bend 30 which prevents rotation of the beam as well as providing an abutment preventing longitudinal movement of the anchored end of the beam. The coupling members are maintained in alignment with a guide pin 48 received in a guide opening 50, there preferably being two such alignment means. Obviously, the pin and alignment aperture can be supported on either of the two coupling members. The members 12 and 14 are secured in coupled position by a screw or bolt 52 received in threaded opening 54. The bolt forces the coupling members 12 and 14 into contact and secures same in a desired relationship.

Figure 2:
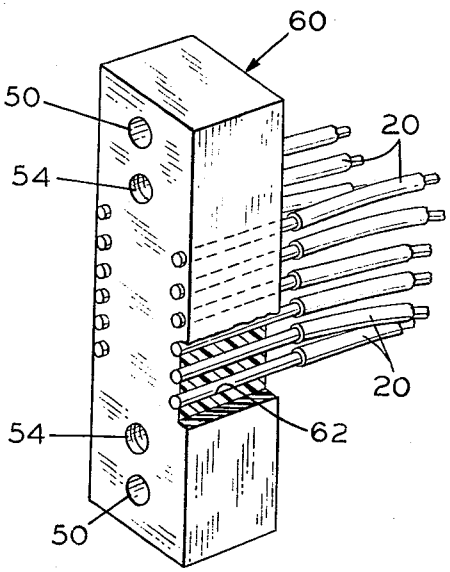
FIG. 2 is a perspective view of one of the coupling members illustrating an alternate embodiment thereof.

Referring now to FIG. 2, there is illustrated another preferred embodiment of the coupling member 60 joined to wires 20. In this embodiment, a plurality of small holes are drilled through or molded in member 60 made of insulating materials which holes are arranged in a predetermined configuration to match the configuration of the buckling beams 28 of the opposing coupling member. In using the embodiment, the ends of wires 20 are stripped and inserted into the holes 62 and secured therein by peening of the ends, or other suitable techniques. Alternately, the wire ends can be embedded into a plastic part. In this embodiment, the ends of the wires cannot be fanned out in securing the abutting elements as in FIG. 1. However, multiple rows of wires can be formed and the opposing portion of the coupling member embodying the buckling beam elements built up into a plurality of layers thereby increasing the number of electrical contacts that can be made.

Figure 3:
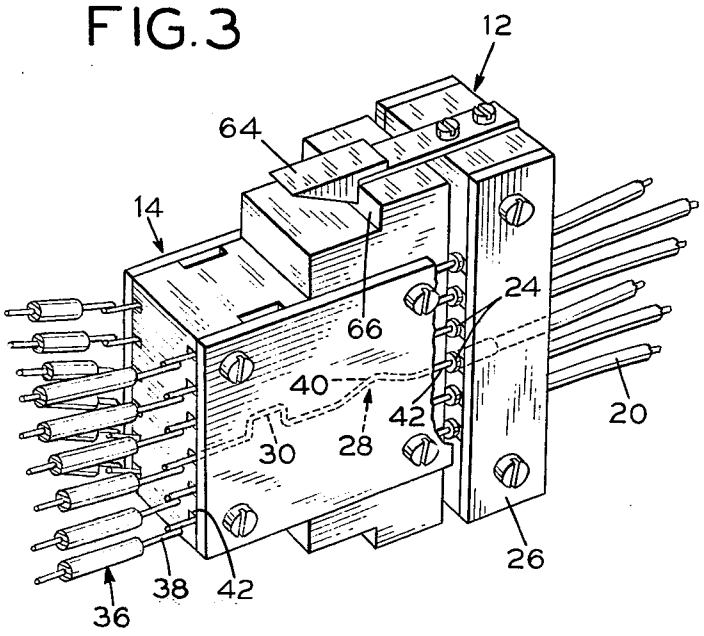
FIG. 3 is a perspective view illustrating a preferred specific embodiment of the means for securing the coupling members in assembled relation.

In FIG. 3 there is illustrated an alternate technique for holding the coupling members 12 and 14 in closed relation. A spring latch 64 is provided on member 12 which engages an abutting surface 66 on coupling member 14.

Figure 4:
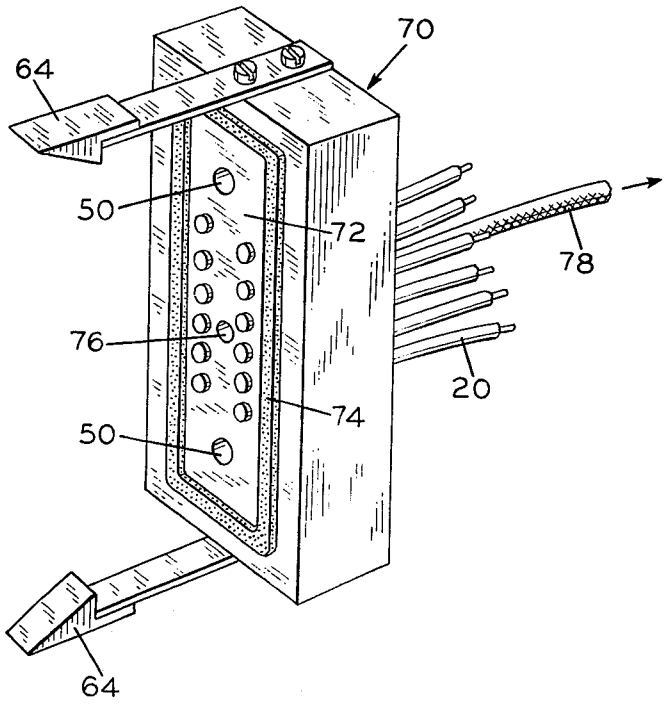
FIG. 4 is a perspective view of one of the mating elements illustrating a means for urging the mating elements in operative connecting relation.

In FIG. 4 there is illustrated yet another embodiment of the invention. The coupling member 70 which corresponds to the members 12 and 60 is provided with a means to draw the elements together in engaging position. On the surface 72, there is provided a seal 74 which can be seated in a groove, or the like, which encloses an annular region on the surface 72. An aperture 76 is provided within the annular area surrounded by seal 74 and connected to a vacuum line 78. In operation, the coupling member 70 is held loosely in position with the opposed coupling member with the aligning pins centered in guide holes 50 and the vacuum applied. The differential air pressure in the volume defined by the seal 74 and the opposing flat surfaces of the coupling members draws the members together and provides a force for buckling the beam elements in the coupling member, not shown. When there are a large number of buckling beam elements, this embodiment facilitates the making of the connection.

While the invention has been particularly shown and described with reference to the preferred embodiments thereof, it will be understood by those skilled in the art that the foregoing and other changes in form and detail may be made therein without departing from the spirit and scope of the invention.

What is claimed is:

1. A connector for forming a plurality of electrical wiring connections comprising:

a first mateable coupling member having a flat surface, a plurality of openings in said first member arranged in a predetermined configuration, a plurality of headed elements disposed in said plurality of openings, said headed elements adapted to be attached to a plurality of electrical wires, a second mateable coupling member provided with a flat surface, a set of elongated flexible metal buckling beam elements, said elements each comprised of a laterally flexible electrically conductive wire having a length that is many times its diameter, said wire having an anchoring portion adjacent one end, a long flexible central portion, and an end portion opposite said anchoring portion, on the other end, support means on said second member for releasably supporting said set of buckling beam elements in aligned positions relative to said plurality of headed elements on said first member with said buckling beam elements protruding slightly beyond said flat surface, said support means including a means to engage said anchor portions of each of said buckling beams to thereby prevent axial movement, means to support said end portion of each of said buckling beams for longitudinally slideable movement, and an enclosure which allows flexing of the central portion of said buckling beam in a single plane, said enclosure including surfaces at opposite sides of said central portions which block said central portions from flexture in directions transverse to said single plane, alignment means for aligning said first member and said second member in mateable relation with the respective flat surfaces in opposed relation and with the protruding ends of said set of beam elements in contact with a plurality of headed elements, and securing means for maintaining said first member and second member in mateable relation and with said beam elements in flexed positions.

2. The connector of claim 1 wherein said plurality of openings in said first coupling member is comprised of a plurality of slots in at least one side of said first member, and at least one flat element secured to the side of said first member over said slots.

3. The connector of claim 2 wherein a plurality of slots is provided on opposite sides of said first member.

4. The connector of claim 3 wherein said headed elements are each comprised of a tubular portion that is seated in said slot in said first member, and an enlarged head portion in abutting relation to said flat surface on said first member.

5. The connector of claim 1 wherein said plurality of openings is circular holes in said first member located perpendicular to said flat surface.

6. The connector of claim 1 wherein said alignment means is comprised of at least two spaced protruding pins on one of said mateable coupling members positioned perpendicular to said flat surface and protruding beyond, and at least two apertures in the other of said mateable coupling member adapted to receive said spaced pins.

7. The connector of claim 1 wherein said securing means is comprised of at least one threaded element extending through and in abutting relation to one of said mateable coupling members, and securable in the other of said mateable coupling member, adapted in use to draw together and hold said members in coupling relation.

8. The connector of claim 1 which further includes a means to draw said first and said second members together, said means comprising:

an annular flexible sealing element disposed on and protruding from the surface of one of said mateable coupling members, a vacuum line through said member adapted to draw a vacuum in the volume within said annular seal when said flat surfaces are disposed in opposed relation.

* * * * *